US007230595B2

(12) United States Patent
Lih et al.

(10) Patent No.: US 7,230,595 B2
(45) Date of Patent: Jun. 12, 2007

(54) ACTIVE-MATRIX ORGANIC LIGHT EMITTING DIODE DISPLAY

(75) Inventors: Jiin-Jou Lih, Taichung (TW); Chun-Huai Li, Wandan Township, Pingtung County (TW)

(73) Assignee: AU Optronics Corp., Hsinchu (TW)

( * ) Notice: Subject to any disclaimer, the term of this patent is extended or adjusted under 35 U.S.C. 154(b) by 575 days.

(21) Appl. No.: 10/797,226

(22) Filed: Mar. 10, 2004

(65) Prior Publication Data

US 2004/0227709 A1 Nov. 18, 2004

(30) Foreign Application Priority Data

May 12, 2003 (TW) ..... 92112784 A

(51) Int. Cl.
*G09G 3/32* (2006.01)

(52) U.S. Cl. ..... 345/82; 345/76

(58) Field of Classification Search ..... 345/76, 345/77, 82, 83; 315/169.1, 169.2, 169.3
See application file for complete search history.

(56) References Cited

U.S. PATENT DOCUMENTS 5,576,726 A 11/1996 Rhyne et al.
6,542,142 B2 * 4/2003 Yumoto et al. ..... 345/90
6,680,580 B1 * 1/2004 Sung ..... 315/169.3
6,891,520 B2 * 5/2005 Chen et al. ..... 345/82
6,950,082 B2 * 9/2005 Sung et al. ..... 345/82

OTHER PUBLICATIONS

China Office Action mailed Oct. 13, 2006.

* cited by examiner

*Primary Examiner*—Kevin M. Nguyen
(74) *Attorney, Agent, or Firm*—Thomas, Kayden, Horstemeyer & Risley

(57) ABSTRACT

An active-matrix organic light emitting diode display. The active-matrix organic light emitting diode display comprises an organic light emitting diode, a first driving transistor, a second driving transistor and a switch transistor. The switch transistor connects and switches the first and second driving transistors. The first driving transistor connects an anode of the organic light emitting diode and a first driving voltage having a first waveform. The second driving transistor connects an anode of the organic light emitting diode and a second driving voltage having a second waveform, wherein the first waveform and the second waveform are complementary to alternatively drive the organic light emitting diode.

5 Claims, 2 Drawing Sheets

ACTIVE-MATRIX ORGANIC LIGHT EMITTING DIODE DISPLAY

BACKGROUND OF THE INVENTION

1. Field of the Invention

The present invention relates to an organic light emitting diode (OLED) display, and in particular to an active-matrix organic light emitting diode (AM-OLED) which increase display life.

2. Description of the Related Art

Organic electroluminescent devices or organic light emitting diode (OLED) displays have the characteristics of self-emission and can be arranged in a matrix without requiring a backlight module. Organic light emitting diode (OLED) displays are thin and light-weight, and also have the advantages of high contrast, high resolution, low power consumption, and wide viewing angle. Due to these advantages, it is expected to that OLEDs will be adopted as the next generation of display devices.

Generally, an active-matrix organic light emitting diode (AM-OLED) display is driven by electric current to provide illumination. FIG. 1 is a circuit configuration scheme of a pixel unit in a conventional active-matrix organic light emitting diode (AM-OLED) display. Referring to FIG. 1, the AM-OLED display pixel unit comprises an organic light emitting diode 1, a switch transistor T1, a driving transistor T2 and a capacitor 2, wherein the transistors T1 and T2 are Thin Film Transistors (TFTs).

As shown in FIG. 1, a display signal "data line" connects the drain of the switch transistor (TFT) T1, and a scan data signal "scan line" connects the gate to switch the switch transistor T1 on and off. Furthermore, a voltage drive source V+ connects the drain of the driving transistor T2 and the source is connected to the anode of an organic light emitting diode 1. A capacitor 2 is coupled between the sources of the transistors T1 and T2. The capacitor 2 can be charged keeping a hold voltage to enable the driving transistor T2 such that a current passes through the driving transistor T2 to drive the organic light emitting diode 1 provide illumination.

As mentioned above, an active-matrix organic light emitting diode (AM-OLED) display requires adequate current passing through the driving transistor T2 to drive the organic light emitting diode 1. Long term use, however, leads to deterioration of the electrical characteristics. Specifically, the threshold voltage increases when current passes through the driving transistor T2 and leads to device degradation. Therefore, after long term use the driving current will degrade such that the illumination and life time of the organic light emitting diode 1 decrease.

As shown in FIG. 1, only a driving transistor T2 is used to drive the organic light emitting diode 1 in a pixel unit of the conventional active-matrix organic light emitting diode (AM-OLED) display. A disadvantage to the current structure is that when the driving transistor T2 is turned on for an extended period of time, the temperature of the driving transistor T2 increases while the threshold voltage decreases due to the heat generated by current continuously passing through the driving transistor T2. Therefore, this pattern of increasing current, temperature, and heat ultimately cause the driving transistor T2 to fail.

To overcome the above mentioned disadvantages, the present invention provides an active-matrix organic light emitting diode (AM-OLED) display with increased life.

SUMMARY OF THE INVENTION

An object of the invention is to provide an active-matrix organic light emitting diode display with increased life.

An active-matrix organic light emitting diode display. The active-matrix organic light emitting diode display comprises an organic light emitting diode, a first driving transistor, a second driving transistor and a switch transistor. The switch transistor connects and switches the first and second driving transistors. The first driving transistor connects an anode of the organic light emitting diode and a first driving voltage having a first waveform. The second driving transistor connects an anode of the organic light emitting diode and a second driving voltage having a second waveform, wherein the first waveform and the second waveform are complementary to alternatively drive the organic light emitting diode.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
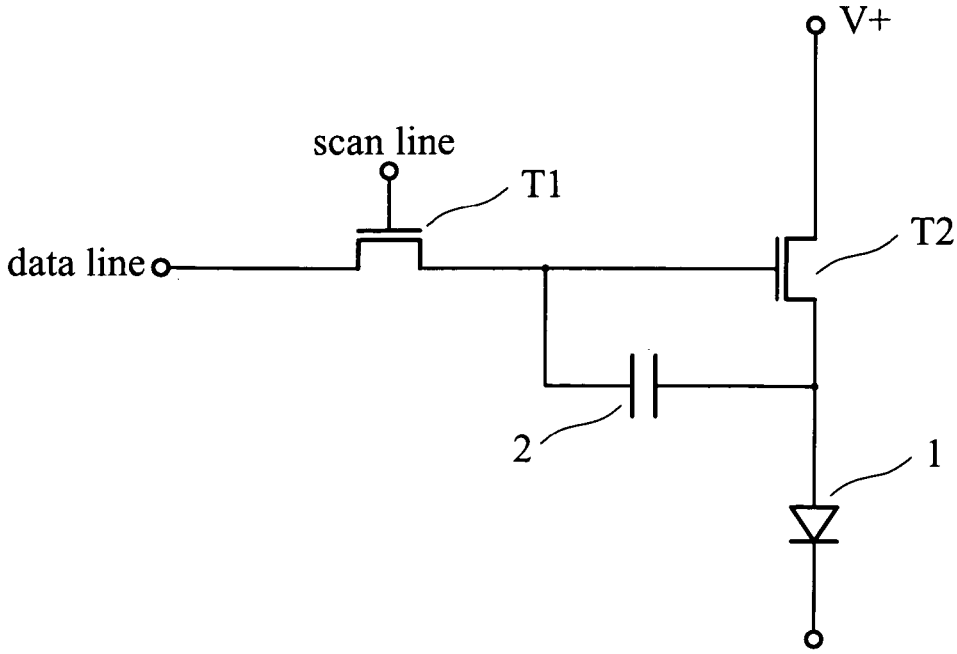
FIG. 1 (PRIOR ART)
FIG. 1 is a circuit configuration scheme of a conventional active-matrix organic light emitting diode (AM-OLED) display.
Figure 2:
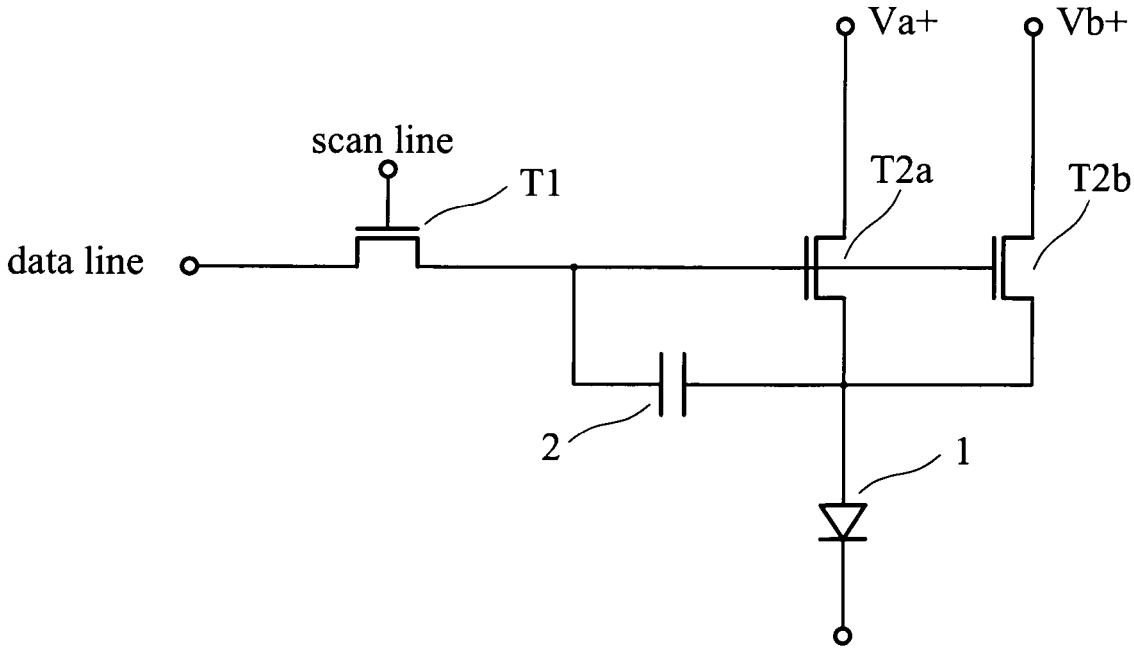
FIG. 2 is a circuit configuration scheme of an active-matrix organic light emitting diode (AM-OLED) display in accordance with the present invention.

FIG. 2 is a circuit configuration scheme of an active-matrix organic light emitting diode (AM-OLED) display in accordance with the present invention. As shown in FIG. 2, the present invention is provided with an organic light emitting diode 1, a capacitor 2, a switch transistor T1, a first driving transistor T2*a* and a second driving transistor T2*b*, wherein the switch transistor T1, the driving transistors T2*a* and T2*b* are all Thin Film Transistors (TFTs).

Referring to FIG. 2, a display signal "data line" connects the drain of the switch transistor T1, and a scan data signal "scan line" connects the gate to switch the transistor T1 on and off. Furthermore, a first voltage drive source Va+ connects the drain of the first driving transistor T2*a* and the source is connected to the anode of the organic light emitting diode 1. A capacitor 2 is coupled between the switch transistor T1 and the source of the first driving transistor T2*a*. The capacitor can be charged keeping a hold voltage to enable the first driving transistor T2*a* such that a current from the first voltage drive source Va+ passes through the first driving transistor T2*a* to drive the organic light emitting diode 1 and provide illumination.

As shown in FIG. 2, the source of the switch transistor T1 also connects and switches the gate of the second driving transistor T2*b*. Furthermore, a second voltage drive source Vb+ connects the drain of the second driving transistor T2*b* and the source connects the anode of the organic light emitting diode 1. Thus, when the second driving transistor T2*b* is enabled, a current from the second voltage drive source Vb+ passes through the second driving transistor T2*a* to drive the organic light emitting diode 1 and provide illumination.

Particularly, when the switch transistor T1 is enabled by the input signals "scan line" and "data line", the organic light emitting diode 1 can be alternatively driven by the first driving transistor T2*a* connected to the first voltage drive source Va+ or the second driving transistor T2*b* connected to the second voltage drive source Vb+. The total current passing through the driving transistors T2*a* and T2*b* determines the brightness of the organic light emitting diode 1. That is, according to the present invention the driving power of the organic light emitting diode 1 can be alternatively provided by utilizing the first voltage drive source Va+ or the second voltage drive source Vb+.

Figure 3:
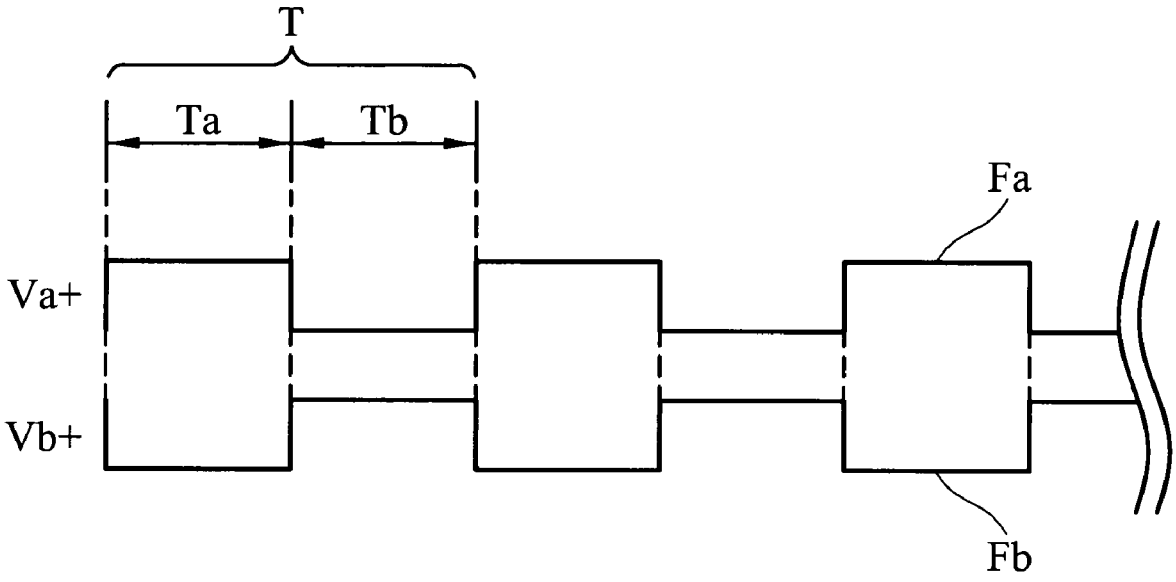
FIG. 3 is a diagram of the first and second waveforms Fa and Fb according to the first and second voltage driving sources Va+ and Vb+ in FIG. 2.

FIG. 3 is a diagram of the first and second waveforms Fa and Fb according to the first and second voltage driving sources Va+ and Vb+ in FIG. 2, wherein the first voltage drive source Va+ has a first waveform Fa and the second voltage drive source Vb+ has a second waveform Fb. As shown in FIG. 3, the first and second waveforms Fa and Fb are complementary to alternatively drive the organic light emitting diode in a time period of T, wherein the amplitude of the first waveform Fa is equal to the second waveform Fb.

Particularly, the first voltage drive source Va+ provides a driving voltage to enable the first driving transistor T2*a* during the period of Ta without the second voltage drive source Vb+ providing power. Alternatively, the second voltage drive source Vb+ provides a driving voltage to enable the second driving transistor T2*b* during the period of Tb without the first voltage drive source Va+ providing power.

In summary, according to the present invention, the organic light emitting diode 1 can be alternatively driven by the first and second voltage driving sources Va+ and Vb+. Thus, the driving current load of the first and second driving transistors T2*a* and T2*b* can be evenly distributed. Moreover, as the first and second driving transistors T2*a* and T2*b* are only intermittently and periodically used, the life time of the transistors increases such that display quality is enhanced. Additionally, as the transistors are only intermittently used, heat can be evenly distributed to prevent damage or transistor failure due to high temperature generated by continuous usage.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An active-matrix organic light emitting diode display, comprising:

an organic light emitting diode;

a first driving transistor, connecting an anode of the organic light emitting diode and a first driving voltage having a first waveform, a second driving transistor, connecting an anode of the organic light emitting diode and a second driving voltage having a second waveform, a switch transistor, connecting and switching the first and second driving transistors, wherein the first waveform and the second waveform are complementary to alternatively drive the organic light emitting diode.

2. The active-matrix organic light emitting diode display as claimed in claim 1, wherein the first driving transistor, the second driving transistor and the switch transistor are Thin Film Transistors (TFTs).

3. The active-matrix organic light emitting diode display as claimed in claim 1 further comprising a capacitor providing a driving voltage to enable the first and second driving transistors.

4. The active-matrix organic light emitting diode display as claimed in claim 1, wherein the first waveform and the second waveform are alternatively complementary square waves.

5. The active-matrix organic light emitting diode display as claimed in claim 1, wherein the amplitude of the first waveform is equal to the second waveform.

* * * * *